US011293177B2

(12) United States Patent
Grisolia

(10) Patent No.: US 11,293,177 B2
(45) Date of Patent: Apr. 5, 2022

(54) WOOD FOUNDATION WALLS AND FOUNDATIONS FORMED WITH SUCH WALLS

(71) Applicant: IBACOS, Inc., Pittsburgh, PA (US)

(72) Inventor: Anthony Grisolia, West Leechburg, PA (US)

(73) Assignee: IBACOS, Inc., Pittsburgh, PA (US)

( * ) Notice: Subject to any disclaimer, the term of this patent is extended or adjusted under 35 U.S.C. 154(b) by 0 days.

(21) Appl. No.: 16/583,483

(22) Filed: Sep. 26, 2019

(65) Prior Publication Data

US 2020/0095764 A1 Mar. 26, 2020

Related U.S. Application Data

(60) Provisional application No. 62/736,719, filed on Sep. 26, 2018.

(51) Int. Cl.

| | |
|---|---|
| ***E04B 2/70*** | (2006.01) |
| ***E04B 1/00*** | (2006.01) |
| ***E02D 31/02*** | (2006.01) |
| ***E04C 2/34*** | (2006.01) |
| ***E04C 2/24*** | (2006.01) |
| *E04B 1/24* | (2006.01) |

(52) U.S. Cl.

CPC ..... *E04B 2/706* (2013.01); *E02D 31/02* (2013.01); *E04B 1/0007* (2013.01); *E04C 2/243* (2013.01); *E04C 2/246* (2013.01); *E04C 2/34* (2013.01); *E02D 2300/0071* (2013.01); *E04B 2001/2481* (2013.01)

(58) Field of Classification Search

CPC ..... E04B 1/0007; E04B 2001/2484; E04B 2001/2481; E04B 2/706; E02D 27/02; E02D 31/02; E02D 2300/0071; Y10S 52/90; Y10S 454/909; E04C 2/243; E04C 2/246; E04C 2/34

See application file for complete search history.

(56) References Cited

U.S. PATENT DOCUMENTS 2,083,781 A * 6/1937 Groves ..... E04B 1/00 52/289
3,216,156 A * 11/1965 Carew ..... E04B 1/24 52/94

(Continued)

FOREIGN PATENT DOCUMENTS

DE 2702310 A1 * 7/1978 ..... E04B 1/10

*Primary Examiner* — Jessie T Fonseca

(74) *Attorney, Agent, or Firm* — The Webb Law Firm

(57) ABSTRACT

A permanent wood foundation wall which includes a frame having a first member, a second member spaced apart from the first member, and two side members. The first member, second member, and two side members each have a front surface and a rear surface that form the front frame surface and the rear frame surface. A cavity is formed between the front frame surface and the rear frame surface of the frame and the first member, second member, and two side members are formed from a wood material including a preservative. Further, the permanent wood foundation wall includes a sheathing board having a first side attached to the rear frame surface of the frame and a second side opposite the first side, a waterproofing membrane applied to the second side of the sheathing board, and a foam layer formed within the cavity of the frame.

23 Claims, 8 Drawing Sheets

(56) References Cited

U.S. PATENT DOCUMENTS 4,281,491 A * 8/1981 Schonert ..... E04B 2/706 52/281
4,877,350 A * 10/1989 DiFiore ..... E02D 31/02 405/38
6,354,050 B1 * 3/2002 Pankoski ..... E02D 31/02 52/126.6
6,634,144 B1 * 10/2003 Moore ..... E02D 31/02 405/38
6,904,723 B1 * 6/2005 Moore ..... E02D 31/02 454/341
7,861,469 B2 * 1/2011 Heady ..... E04G 23/0229 52/127.2
8,925,270 B2 1/2015 Grisolia et al.
9,963,875 B1 * 5/2018 Prygon ..... E04B 1/7641
2007/0051058 A1 * 3/2007 Kestermont ..... E02D 27/01 52/293.3
2007/0294974 A1 * 12/2007 Tonyan ..... B28C 5/147 52/481.1
2008/0172982 A1 * 7/2008 Rothgeb ..... E04B 2/02 52/745.05
2008/0184660 A1 * 8/2008 Forner ..... E02D 31/02 52/745.05
2010/0071292 A1 * 3/2010 Futterman ..... E04F 13/042 52/412
2010/0088981 A1 * 4/2010 Taraba ..... E04B 1/0007 52/169.11
2012/0085049 A1 * 4/2012 Schiffmann ..... E04C 2/246 52/293.1
2013/0233164 A1 * 9/2013 Kestermont ..... E04B 1/10 89/36.04
2015/0128518 A1 * 5/2015 Knight ..... E04F 13/0808 52/404.1
2015/0322671 A1 * 11/2015 Lichtenfeld ..... E04B 1/98 52/167.1
2016/0319555 A1 * 11/2016 Norwood ..... E04B 1/7076
2017/0101542 A1 * 4/2017 Lu ..... C09D 131/04
2018/0282998 A1 * 10/2018 Wang ..... C08J 9/141

* cited by examiner

WOOD FOUNDATION WALLS AND FOUNDATIONS FORMED WITH SUCH WALLS

BACKGROUND OF THE INVENTION

Field of the Invention

The present invention relates to wood based foundation walls and related areas such as crawlspaces formed with the wood based foundation walls.

Description of Related Art

Current methods for constructing residential foundation walls, such as for northern climate basements or southeastern crawlspaces, require pouring concrete and/or using block masonry. For instance, current methods for constructing residential foundation walls typically require pouring concrete to form the footers and the interior floor of the basement and/or using concrete blocks. While concrete and block masonry provide a stable foundation wall, the process is time consuming, costly, and labor intensive. As such, it is desirable to provide improved foundation walls that overcome the deficiencies of current foundation walls that require pouring concrete and/or using block masonry.

SUMMARY OF THE INVENTION

In certain non-limiting embodiments, the present invention includes a permanent wood foundation wall. The foundation wall comprises a frame that includes a first member, a second member spaced apart from the first member, and two side members extending between the first and second members. The first member, second member, and two side members each have a front surface and a rear surface that form the front frame surface and the rear frame surface of the frame. A cavity is formed between the front frame surface and the rear frame surface of the frame and the first member, second member, and two side members are formed from a wood material comprising a preservative. Further, the permanent wood foundation wall includes a sheathing board comprising a first side attached to the rear frame surface of the frame and a second side opposite the first side, a waterproofing membrane applied to the second side of the sheathing board, and a foam layer formed within the cavity of the frame and which is bounded by the first member, the second member, two side members, and the sheathing board.

In some non-limiting embodiments, the permanent wood foundation wall further comprises an additional board attached to the front frame surface of the frame. The additional board can include drywall, for example. A gap can also be formed within the frame between the foam layer and the front frame surface.

In some non-limiting embodiments, the frame further includes at least one primary support member positioned between the two side members and extending between the first and second member in which the primary support member defines a front primary support surface and an opposite rear primary support surface corresponding to the front frame surface and rear frame surface. The frame can also include one or more secondary support members extending between the two side members.

In certain non-limiting embodiments, the foam layer is formed in situ during the manufacturing process. Moreover, in some non-limiting embodiments, the preservative is a copper based preservative such as a chromated copper arsenate preservative. The copper based preservative can have a minimum retention level of 0.30 lbs per cubic foot of wood.

Further, the waterproofing membrane can comprise a rubberized membrane, a UV resistant polyethylene sheet with all seams and overlaps embedded into a sealant material, or a combination thereof. The sheathing board can comprise polyisocyanurate, wood, high density insulation, composites of plastic materials, metal (e.g., metal sheet and/or metal netting), or any combination thereof. In addition, at least a portion of the second side of the sheathing board can comprise a cementitious parge coating.

The present invention also includes a foundation or crawlspace of a building comprising: (i) a gravel base layer; and (ii) the previously described permanent wood foundation wall positioned over the gravel base layer. A concrete footer can also be positioned between at least a portion of the second member of the frame and the gravel base. Further, a rod can be placed through the second member of the permanent wood foundation wall and the gravel base layer.

The present invention is also directed to the following clauses.

Clause 1: A permanent wood foundation wall comprising: (a) a frame comprising: a first member; a second member spaced apart from the first member; and two side members extending between the first and second members, wherein the first member, second member, and two side members each have a front surface and a rear surface that form the front frame surface and the rear frame surface of the frame, and wherein a cavity is formed between the front frame surface and the rear frame surface of the frame, wherein the first member, second member, and two side members are formed from a wood material comprising a preservative; (b) a sheathing board comprising a first side attached to the rear frame surface of the frame and a second side opposite the first side; (c) a waterproofing membrane applied to the second side of the sheathing board; and (d) a foam layer formed within the cavity of the frame and which is bounded by the first member, the second member, two side members, and the sheathing board.

Clause 2: The permanent wood foundation wall according to clause 1, further comprising an additional board attached to the front frame surface of the frame.

Clause 3: The permanent wood foundation wall according to clause 2, wherein the additional board is drywall.

Clause 4: The permanent wood foundation wall according to any of clauses 1-3, wherein a gap is formed within the frame between the foam layer and the front frame surface.

Clause 5: The permanent wood foundation wall according to any of clauses 1-4, wherein the foam layer is formed in situ during the manufacturing process.

Clause 6: The permanent wood foundation wall according to any of clauses 1-5, wherein the preservative is a copper based preservative.

Clause 7: The permanent wood foundation wall according to clause 6, wherein the copper based preservative has a minimum retention level of 0.30 lbs per cubic foot of wood.

Clause 8: The permanent wood foundation wall according to any of clauses 1-7, wherein the frame further comprises at least one primary support member positioned between the two side members and extending between the first and second member, wherein the primary support member defines a front primary support surface and an opposite rear primary support surface corresponding to the front frame surface and rear frame surface.

Clause 9: The permanent wood foundation wall according to any of clauses 1-8, wherein the frame further comprises one or more secondary support members extending between the two side members.

Clause 10: The permanent wood foundation wall according to any of clauses 1-9, wherein the waterproofing membrane comprises a rubberized membrane, a UV resistant polyethylene sheet with all seams and overlaps embedded into a sealant material, or a combination thereof.

Clause 11: The permanent wood foundation wall according to any one of clauses 1-10, wherein the sheathing board comprises polyisocyanurate, wood, high density insulation, composites of plastic materials, metal, or any combination thereof.

Clause 12: The permanent wood foundation wall according to any one of clauses 1-11, wherein the sheathing board comprises polyisocyanurate.

Clause 13: The permanent wood foundation wall according to any of clauses 1-12, wherein at least a portion of the second side of the sheathing board comprises a cementitious parge coating.

Clause 14: A foundation or crawlspace of a building comprising: (i) a gravel base layer; and (ii) a permanent wood foundation wall positioned over the gravel base layer, the permanent wood foundation wall comprising: (a) a frame comprising: a first member; a second member spaced apart from the first member; and two side members extending between the first and second members, wherein the first member, second member, and two side members each have a front surface and a rear surface that form the front frame surface and the rear frame surface of the frame, and wherein a cavity is formed between the front frame surface and the rear frame surface of the frame, wherein the first member, second member, and two side members are formed from a wood material comprising a preservative; (b) a sheathing board comprising a first side attached to the rear frame surface of the frame and a second side opposite the first side; (c) a waterproofing membrane applied to the second side of the sheathing board; and (d) a foam layer formed within the cavity of the frame and which is bounded by the first member, the second member, two side members, and the sheathing board.

Clause 15: The foundation or crawlspace according to clause 14, wherein a concrete footer is positioned between at least a portion of the second member of the frame and the gravel base.

Clause 16: The foundation or crawlspace according to clauses 14 or 15, further comprising an additional board attached to the front frame surface of the frame.

Clause 17: The foundation or crawlspace according to clause 16, wherein the additional board is drywall.

Clause 18: The foundation or crawlspace according to any of clauses 14-17, wherein a gap is formed within the frame between the foam layer and the front frame surface.

Clause 19: The foundation or crawlspace according to any of clauses 14-18, wherein the foam layer is formed in situ during the manufacturing process.

Clause 20: The foundation or crawlspace according to any of clauses 14-19, wherein the preservative is a copper based preservative.

Clause 21: The foundation or crawlspace according to any of clauses 14-20, wherein the waterproofing membrane comprises a rubberized membrane, a UV resistant polyethylene sheet with all seams and overlaps embedded into a sealant material, or a combination thereof.

Clause 22: The foundation or crawlspace according to any of clauses 14-21, wherein the sheathing board comprises polyisocyanurate, wood, high density insulation, composites of plastic materials, metal, or any combination thereof.

Clause 23: The foundation or crawlspace according to any of clauses 14-22, wherein at least a portion of the second side of the sheathing board comprises a cementitious parge coating Clause 24: The foundation or crawlspace according to any of clauses 14-23, further comprising a rod that extends through the second member of the permanent wood foundation wall and the gravel base layer.

DESCRIPTION OF THE INVENTION

Figure 1:
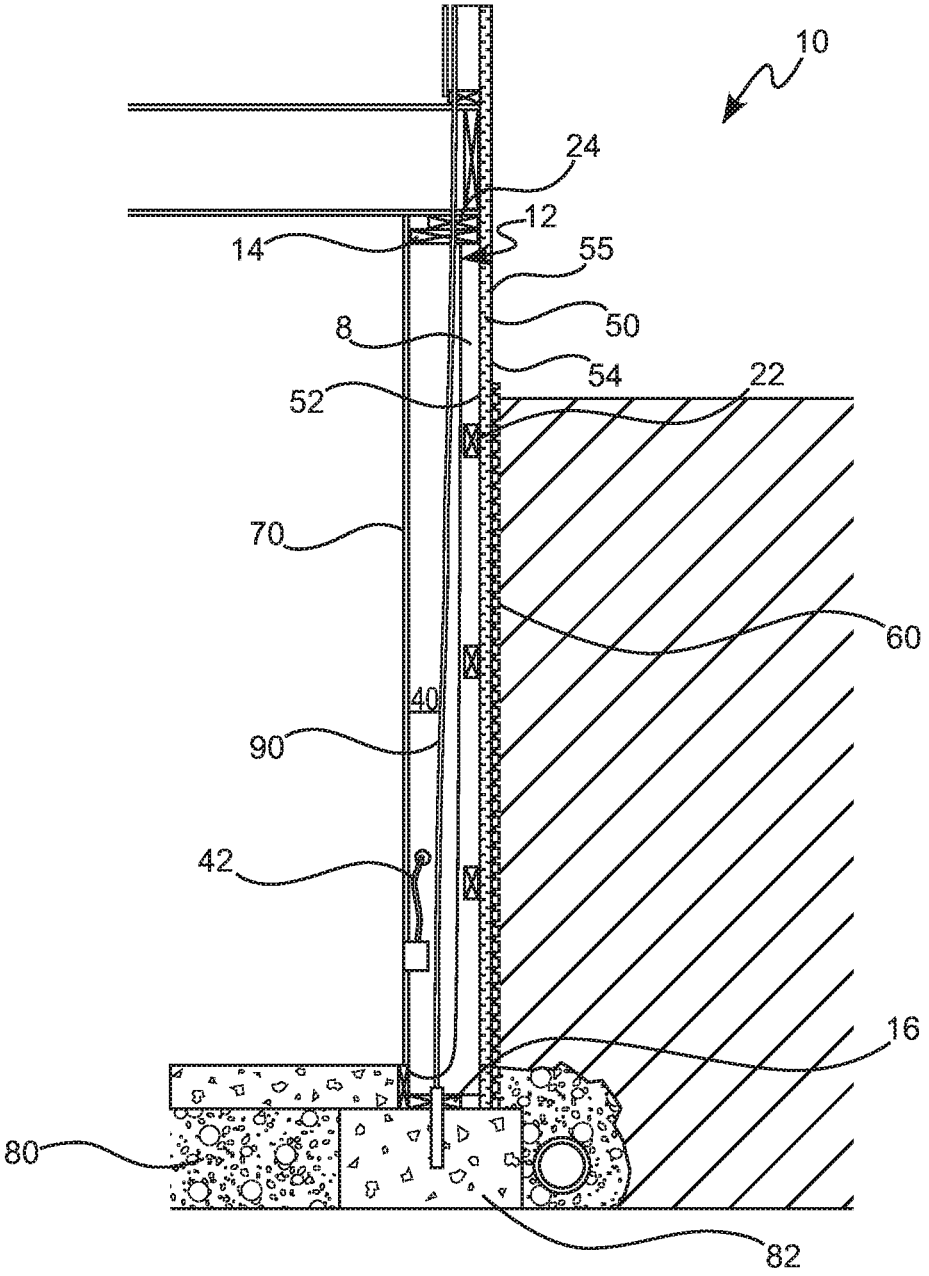
FIG. 1 illustrates a side cross-sectional view of a permanent wood foundation wall according to the present invention.

For purposes of the following detailed description, it is to be understood that the invention may assume various alternative variations and step sequences, except where expressly specified to the contrary. Moreover, other than in any operating examples, or where otherwise indicated, all numbers expressing, for example, quantities of ingredients used in the specification and claims are to be understood as being modified in all instances by the term "about". Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

Further, the terms "upper," "lower," "right," "left," "vertical," "horizontal," "top," "bottom," "lateral," "longitudinal," and derivatives thereof shall relate to the invention as it is oriented in the drawing figures. However, it is to be understood that the invention may assume alternative variations and step sequences, except where expressly specified to the contrary. It is also to be understood that the specific devices and processes illustrated in the attached drawings, and described in the specification, are simply exemplary embodiments and aspects of the invention. Hence, specific dimensions and other physical characteristics related to the embodiments and aspects disclosed herein are not to be considered as limiting.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

Figure 2:
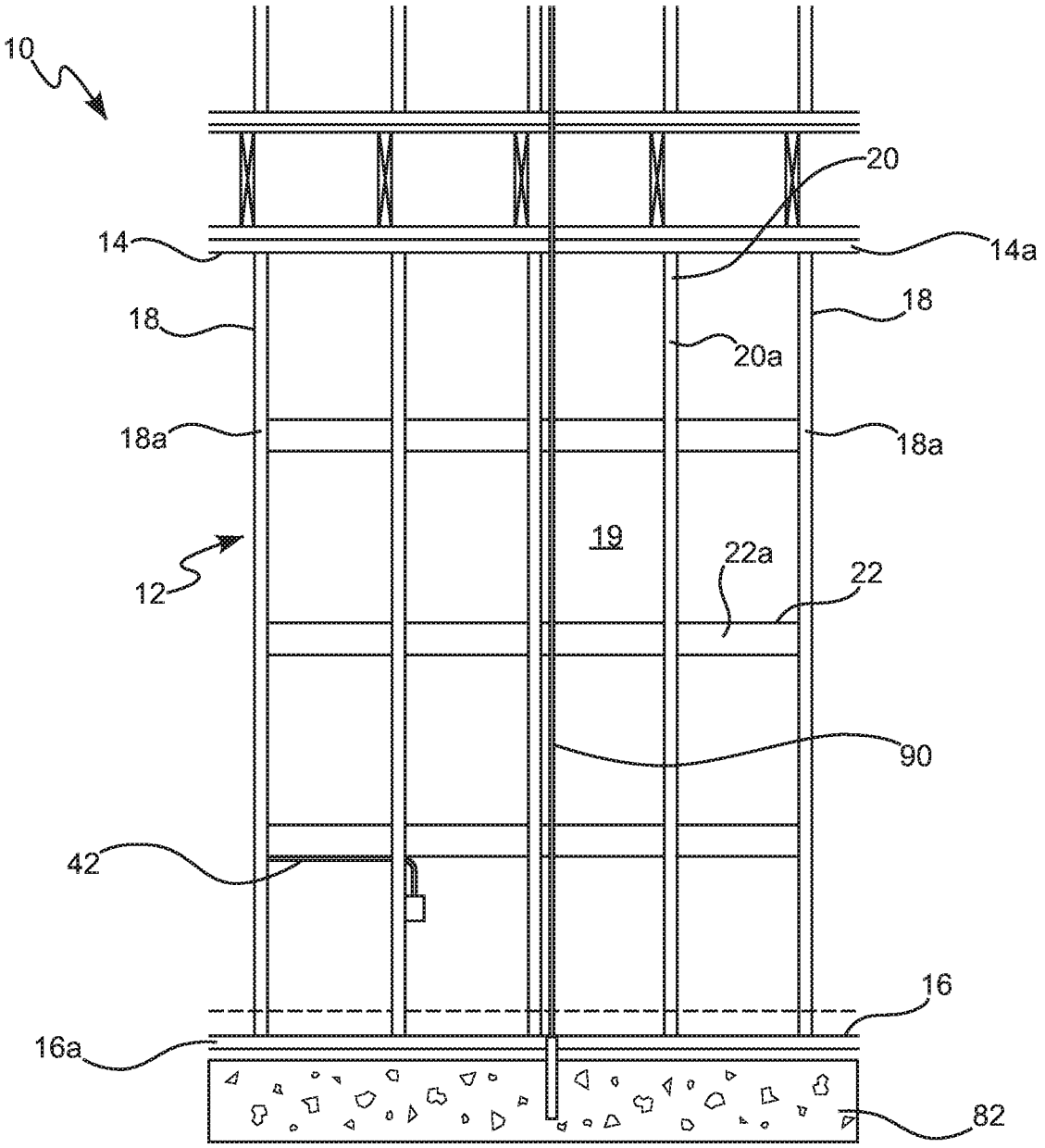
FIG. 2 illustrates a front view of the permanent wood foundation wall shown in FIG. 1.
Figure 3:
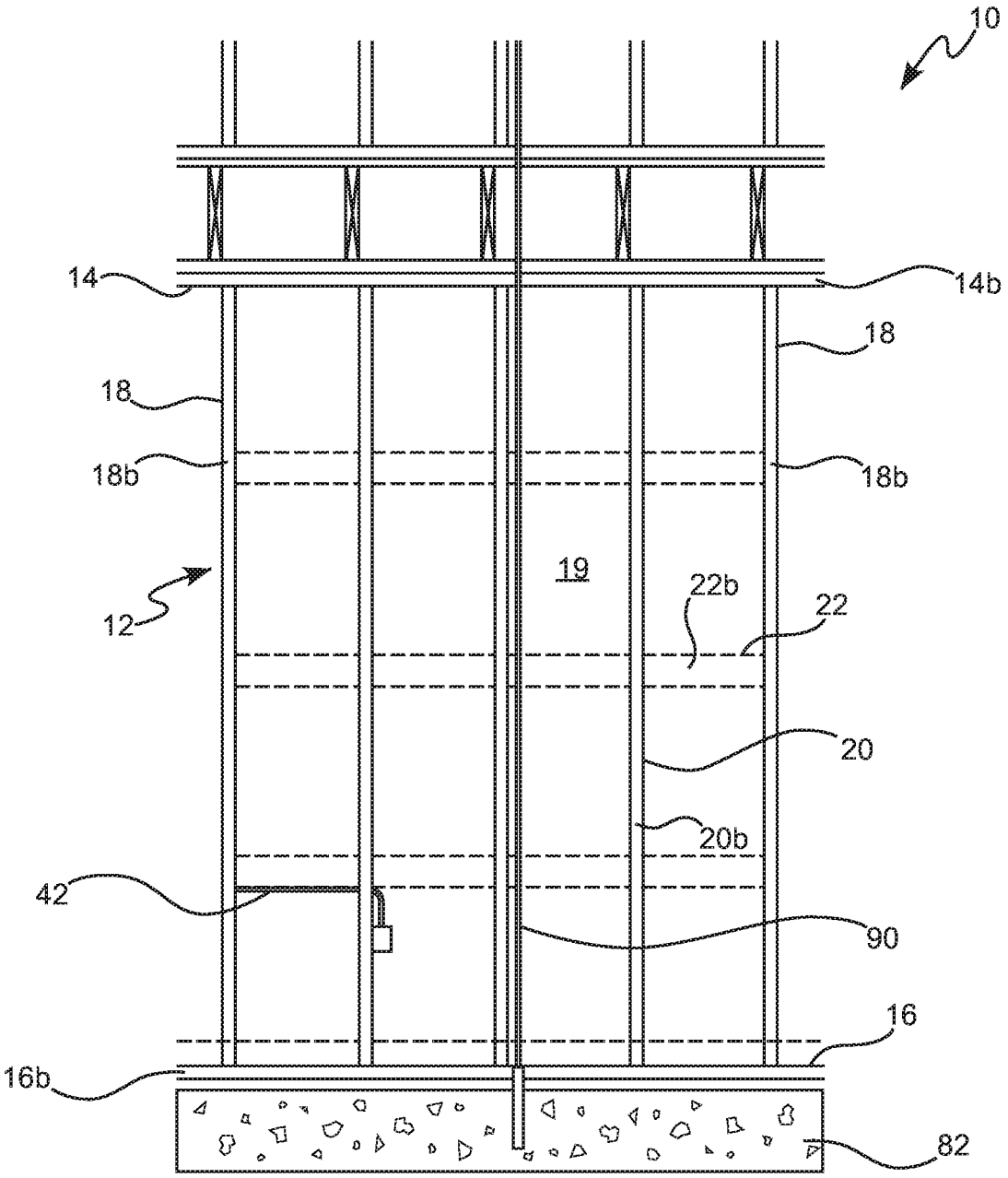
FIG. 3 illustrates a rear view of the permanent wood foundation wall shown in FIG. 1.

Referring to FIGS. 1-3, in certain non-limiting embodiments, the present invention includes a wood foundation wall 10 having a frame 12 and a foam layer 8. As shown in FIGS. 2 and 3, the frame 12 is defined by a first member 14, a second member 16 spaced apart from the first member 14, and two side members 18 extending between the first member 14 and the second member 16. In certain non-limiting embodiments, the first member 14, second member 16, and two side members 18 each have a front surface 14*a*, 16*a*, 18*a* and a rear surface 14*b*, 16*b*, 18*b* that define a front frame surface 12*a* and a rear frame surface 12*b*, respectively.

The frame 12 can be constructed into different shapes. In certain embodiments, as shown in FIGS. 1-3, the frame 12 can be constructed as a conventional industry standard rectangular or square frame 12. For example, as shown in FIGS. 2 and 3, the first member 14 and second member 16 may be spaced apart and extend parallel to each other, and the two side members 18 may extend perpendicular to the first member 14 and second member 16 so as to form a rectangular or square frame 12. The shape and design of the frame 12 is not so limited and can be constructed into any desired shape.

The frame 12 can also include additional members such as primary support members 20 that are positioned between the two side members 18 and which extend from the first member 14 to the second member 16. The primary support members 20 may define a front primary support surface 20*a* and a rear primary support surface 20*b*.

In certain embodiments, the first member 14, second member 16, two side members 18, and optionally, primary support members 20 are spaced apart to form cavities 19. The cavities 19 may be defined by the area between the primary support members 20, two side members 18, first member 14, and/or second member 16. The size of each cavity 19 will vary based on the size of the frame 12.

Further, the primary support members 20, side members 18, first member 14, and/or second member 16 may comprise one or more plates, boards, beams, or the like. In certain embodiments, the two side members 18 and/or primary support members 20 are fixedly engaged to the first member 14 and second member 16. For instance, in certain embodiments, the two side members 18 and/or primary support members 20 are fixedly engaged to the first member 14 and second member 16 with fasteners. Suitable fasteners that can be used with the present invention include, but are not limited to, nails, staples, bolts, screws, plates, and rivets.

The dimensions of the first member 14, second member 16, two side members 18, and primary support members 20 can vary. In certain embodiments, the first member 14, second member 16, two side members 18, and primary support members 20 have the same dimensions. For example, the first member 14, second member 16, two side members 18, and primary support members 20 may have the same width and height dimensions. In one non-limiting embodiment, the first member 14, second member 16, two side members 18, and primary support members 20 all have a width and height dimension of nominally 2×4 inches, 2×6 inches, or 2×8 inches.

In certain non-limiting embodiments, the first member 14, second member 16, and two side members 18 have the same dimensions that are different from the dimensions of the primary support members 20. For example, the first member 14, second member 16, and two side members 18 may have the same width and height dimensions, and the primary support members 20 may have width and height dimensions that are different from the first member 14, second member 16, and two side members 18.

In addition to the above, and as shown in FIGS. 1-3, one or more secondary support members 22 may be used. The secondary support members 22 may comprise one or more boards, beams, or the like. The secondary support members 22 are incorporated into the frame 12 to provide structural support. Further, the secondary support members 22 can have dimensions that are the same or different from the primary support members 20, side members 18, first member 14, and/or second member 16. As shown in FIGS. 1-3, the secondary support members 22 may have a front secondary support surface 22*a* and a rear secondary support surface 22*b*. It is appreciated that the secondary support members 22 can help form the cavities 19.

In certain non-limiting embodiments, additional support members and structural elements may also be used. For example, a header 24 may be used to provide additional support. Other additional support members may be used for structural purposes, design purposes, and the like.

In accordance with the present invention, the frame 12 is formed from a wood material comprising a preservative. As such, the first member 14, second member 16, and two side members 18 are made of a wood material comprising a preservative. When additional members are used such as a primary support member 20 and/or a secondary support member 22, the additional members can be made of a wood material comprising a preservative. As used herein, a "preservative" refers to a material that inhibits and protects wood against decay and rot. By using a preservative, the frame 12 is suitable as a frame 12 for a foundation wall 10 that can be used in conditions that would otherwise decay or rot a wood material.

Non-limiting examples of a wood preservative include a copper based preservative such as a chromated copper arsenate preservative. The copper based preservative can have a minimum retention level of 0.30 lbs per cubic foot of wood, or a minimum retention level of 0.60 lbs per cubic foot of wood. As used herein, a "retention level" refers to the amount of preservative left in the wood being with a preservative. The retention is measured by pounds of preservative per cubic foot of the wood.

In certain embodiments, a foam material is deposited into the frame 12. As used herein, the term "foam material" refers to a substance that is formed by trapping pockets of gas in a liquid or solid. In some non-limiting embodiments, the foam material is a closed-cell foam. As used herein, "closed-cell foam" refers to foam that contains discrete, non-interconnecting cells. Non-limiting examples of foam material that can be used with the present invention include materials made with polyurethane, polyisocyanurate (also referred to as polyiso), and mixtures thereof.

In some embodiments, the foam material may be substantially free, may be essentially free, and may be completely free of halogen containing flame retardant additives. The term "halogen" refers to the halogen elements, which include fluorine, chlorine, bromine, and iodine, and the term "halogen containing flame retardant additives" refers to a substance that may be used to inhibit or resist the spread of fire and which contains halogen groups such as a fluoro, chloro, bromo, and/or iodo group. Further, the term "substantially free" as used in this context means the foam material contains less than 1000 parts per million (ppm), "essentially free" means less than 100 ppm, and "completely free" means less than 20 parts per billion (ppb) of halogen containing flame retardant additives.

The foam material can be deposited into the frame 12 such that the foam material forms a foam layer 8 within at least a portion of the frame 12 between the front frame surface 12*a* and the rear frame surface 12*b*. The foam layer 8 may extend beyond the front primary support surfaces 20*a* such that the foam layer 8 overlies the front support surfaces to form a continuous or uninterrupted exposed foam surface. As used herein, "continuous or uninterrupted foam layer" refers to a foamed material that is connected or bonded along at least one path without a break or interruption.

In certain embodiments, the foam layer 8 extends beyond the front primary support surfaces 20*a* and the front frame surface 12*a*. As such, the foam layer 8 forms a continuous or uninterrupted exposed foam surface over the front primary support surfaces 20*a* and the front frame surface 12*a*.

Alternatively, the foam layer 8 does not extend beyond the front frame surface 12*a*. For example, the foam layer 8 can only extend beyond the front primary support surfaces 20*a*. In some non-limiting embodiments, the foam layer 8 forms a continuous or uninterrupted exposed foam surface over the front primary support surfaces 12*a* and is flush or contained between the front and rear frame surfaces 12*a*, 12*b*.

The foam layer 8 can be dimensioned to expand from the uninterrupted exposed surface to a position intermediate the front frame surface 12*a* and rear frame surface 12*b*, thereby forming a gap or opening 40 within the foam wall structure 10 between the foam layer 8 and the front frame surface 12*a*. This gap 40 can be used as an area to incorporate home utility components 42 such as electrical wires, cords, heating and cooling pipes, and plumbing fixtures. These home utility components 42 may be inserted into the gap 40 located between the foam layer 8 and the rear frame surface 12*b* such that utility components 42 are not surrounded or contacting the foam layer 8. In certain embodiments, the gap 40 comprises at least two inches as measured between the foam layer 8 and the front frame surface 12*a*.

Figure 4:
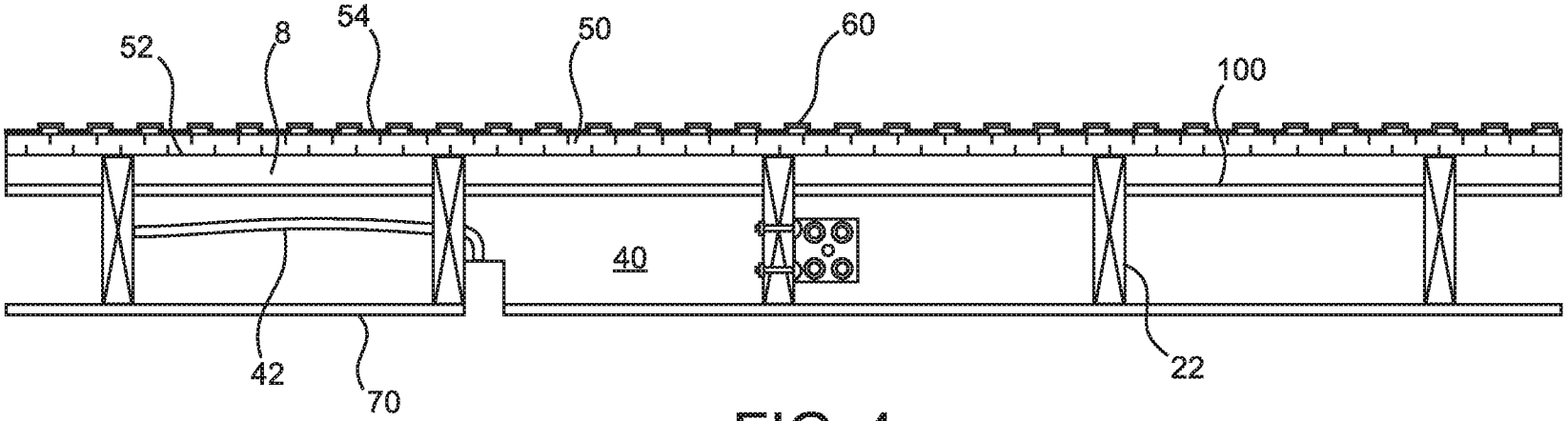
FIG. 4 illustrates an expanded view of a portion of a permanent wood foundation wall according to the present invention.
Figure 5:
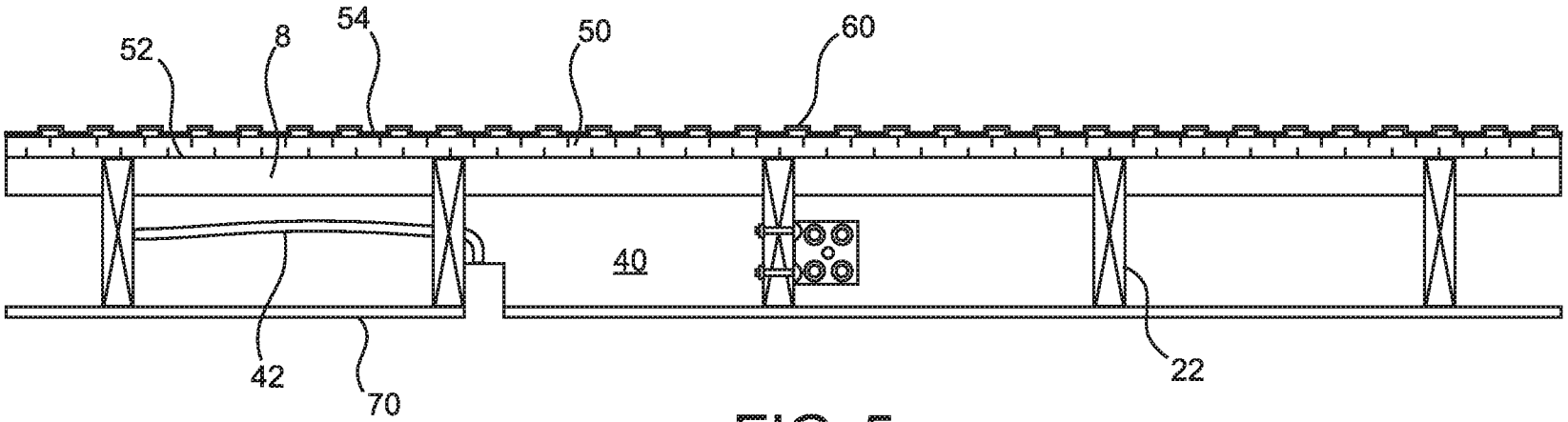
FIG. 5 illustrates an expanded view of a portion of another permanent wood foundation wall according to the present invention.

As shown in FIGS. 4 and 5, the secondary support members 22 can extend through the foam layer 8. FIG. 4 further illustrates horizontal blocking members 100 (e.g. wood, plastic, metal, or any combination thereof) that can be placed between the secondary support members 22 to provide more strength to the foundation wall 10. The spacing and size of the secondary support members 22 is determined by the foundation wall 10 design, location, soil type, and back fill height.

Further, the foam layer 8 can be formed in-situ during the manufacturing process. The term "formed in situ during the manufacturing process" refers to the formation of a foam layer 8 as described herein during manufacturing of the wood foundation wall structure 10 off-site at a facility remote or away from a building construction site. As such, the foam layer 8 may not be formed at a construction site as is required by conventional methods.

The foam layer 8 is able to fill tight spaces and seal gaps 40 that are not visible to the naked eye. The foam layer 8, such with an uninterrupted exposed foam surface, also acts as a vapor and thermal insulating barrier, which reduces energy consumption in buildings and residential homes when the present invention is used as a wall panel. In addition, the foam layer 8 provides structural stability to the foam wall structure 10 such as improved wall racking strength. As used herein, "wall racking strength" refers to the ability of a wall structure to maintain its shape under duress.

In certain embodiments, the foam layer 8 may include a coating adhered to at least a portion of the exposed foam surface. As used herein, the term "coating" includes a partial or continuous film or layer that can be applied to a surface. Non-limiting examples of coatings that can be adhered or attached to the exposed foam surface includes coatings that provide protection from ultraviolet (UV) radiation, weathering, or a combination thereof. The coating 36 can also provide stability to the exposed foam surface. For example, the coating 36 may include fibrous materials such as, but not limited to, glass fibers.

An example of a frame structure having a foam layer is described in U.S. Pat. No. 8,925,270, which is incorporated by reference herein in its entirety.

In accordance with the present invention, a sheathing board 50 is attached to the rear frame surface 12*b*. In particular, and as shown in FIG. 1, the sheathing board 50 comprises a first side 52 attached to the rear frame surface 12*b*, such as directly to the rear frame surface 12*b*, and a second side 54 opposite the first side 52. Non-limiting examples of a sheathing board include a board formed with polyisocyanurate, wood, high density insulation, composites of plastic materials, metal, and any combination thereof.

In certain non-limiting embodiments, the sheathing board 50 is applied to the frame 12 off-site at a facility remote or away from a building construction site. Further, the sheathing board 50 can be applied to the frame 12 such that the sheathing board 50 is applied over the entire rear frame surface 12*b*. The sheathing board 50 can also have a coated glass facer on the front and/or back of the board 50. It was found that the sheathing board 50 provides good water resistance and additional strength.

In certain non-limiting embodiments, at least a portion of the second side 54 of the sheathing board 50 comprises a cementitious parge coating 55. The cementitious parge coating 55 can also be applied over the coated glass facer when used. A "cementitious parge coating" refers to a partial or continuous film or layer of cementitious or polymeric mortar. The cementitious parge coating 55 helps provide water-resistant properties. In some non-limiting embodiments, the cementitious parge coating 55 is only applied over a portion of the sheathing board 50 that is not applied over the foundation walls. Alternatively, the cementitious parge coating 55 is applied over an entire portion of the second side 54 of the sheathing board 50. The cementitious parge coating 55 can also be applied off-site at a facility remote or away from a building construction site.

In some non-limiting embodiments, a waterproofing membrane 60 is applied to the second side 54 of the sheathing board 50. The waterproofing membrane 60 can be applied directly to the sheathing board 50, or the waterproofing membrane 60 can be applied to the sheathing board 50 after application of a cementitious parge coating 55. The waterproofing membrane 60 can be applied over a portion of the sheathing board 50 such as, in certain embodiments, over a portion of the sheathing board 50 that does not have a cementitious parge coating 55 for example. In some non-limiting embodiments, the waterproofing membrane 60 can be applied over the entire portion of the sheathing board 50, directly or over a cementitious parge coating 55 or both. The waterproofing membrane 60 can be applied off-site at a facility remote or away from a building construction site.

Non-limiting examples of waterproofing membranes 60 include a rubberized membrane, a UV resistant polyethylene sheet with all seams and overlaps embedded into a sealant material, or a combination thereof. Further, non-limiting examples of sealant materials include heat sealable polymeric materials.

The wood foundation wall 10 can also include additional components. For example, the wood foundation wall 10 can have additional board(s) 70 attached to the front frame surface 12*a* of the frame 12. The additional board(s) 70 can include, but are not limited to, gypsum boards. The wood foundation wall 10 can further include additional end plates at the corners.

The wood foundation wall 10 can be prepared using various techniques. In certain non-limiting embodiments, the wood foundation wall 10 is prepared off-site such as, for example, by first forming the frame 12 horizontally on a framing table. The wood materials used to form the frame 12 are treated with a preservative as previously described. A sheathing board 50 can then be applied to the rear frame surface 12*b* of the frame 12. After turning the frame 12 to the opposite side, foam can be sprayed into the cavities 19 to form the foam layer 8. The wood foundation wall 10 can be turned again to apply a cementitious parge coating 55 over at least a portion of the sheathing board 50 followed by a waterproofing membrane 60. After placing the wood foundation wall 10 in a building, additional boards 70 such as a gypsum board can be placed over the front frame surface 12*a* of the wall 10.

Figure 6:
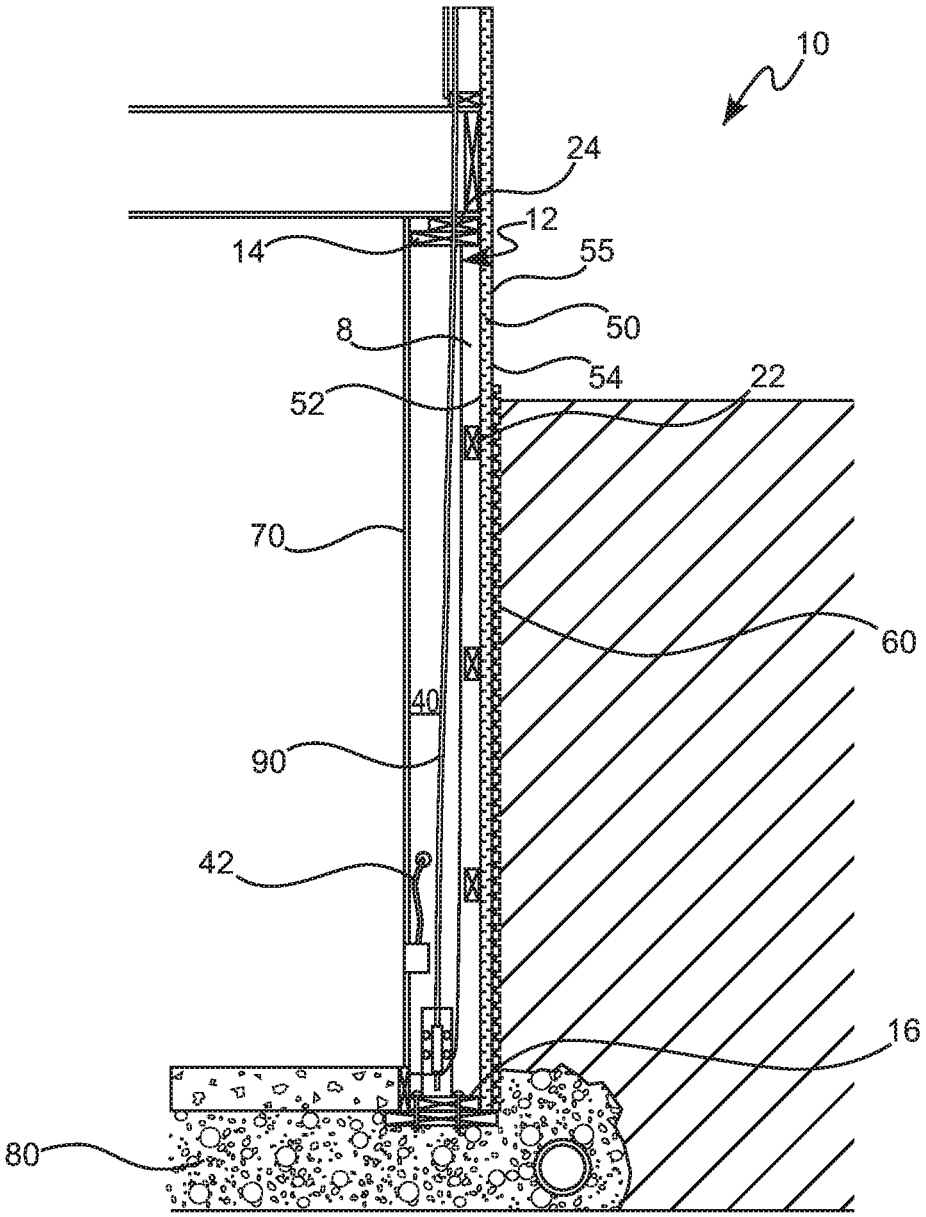
FIG. 6 illustrates a side cross-sectional view of another permanent wood foundation wall according to the present invention.
Figure 7:
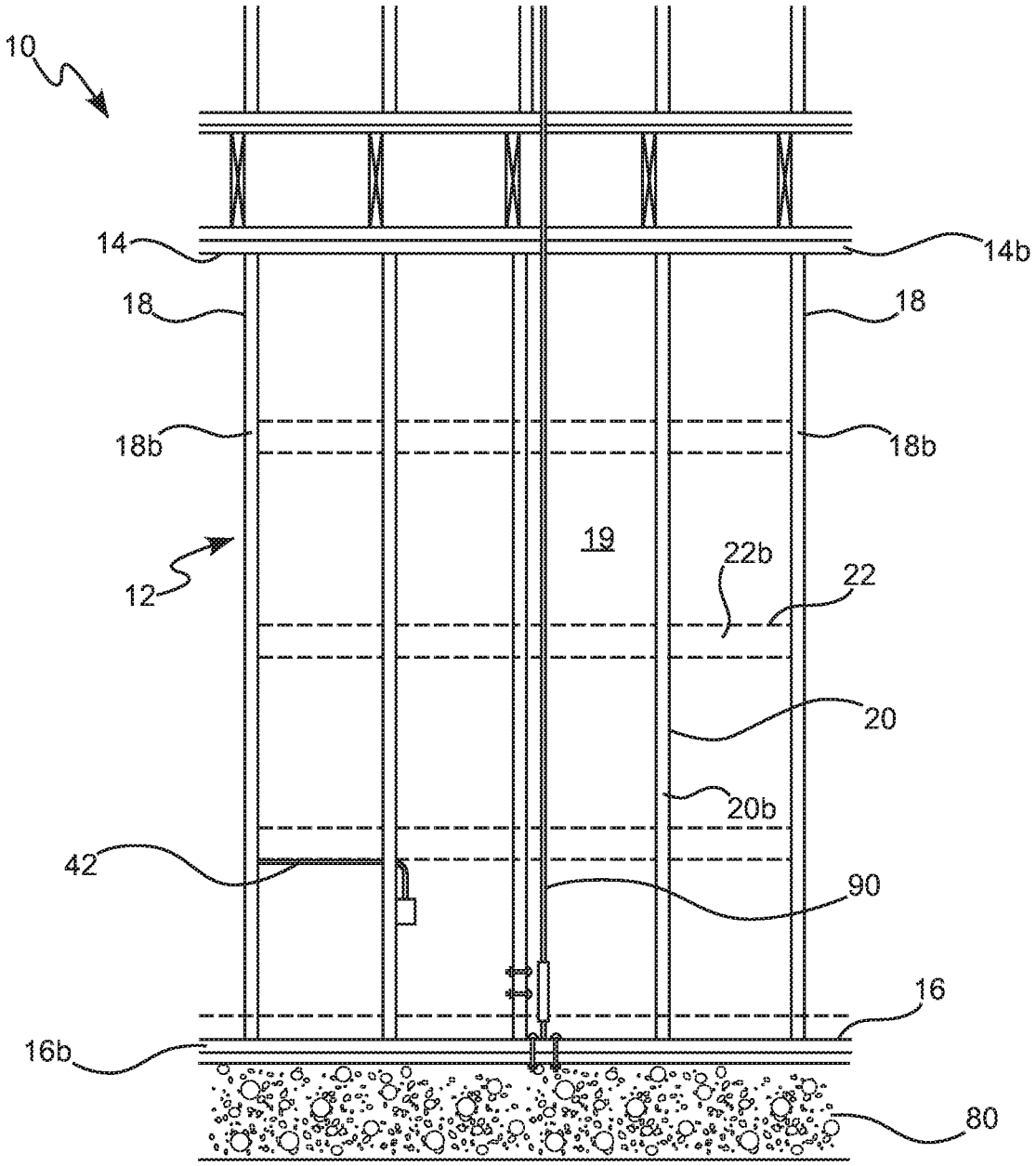
FIG. 7 illustrates a rear view of the permanent wood foundation wall shown in FIG. 6.

As indicated, the claimed invention is also directed to a foundation or crawlspace of a building that can include any of the previously described wood foundation walls 10. The foundation or crawlspace can comprise a gravel base layer 80 and a permanent wood foundation wall 10 positioned over the gravel base layer 80. As shown in FIG. 1, a concrete footer 82 can further be positioned between at least a portion of the frame 12, such as the second member 16 of the frame 12, and the gravel base layer 80. Alternatively, and as shown in FIGS. 6 and 7, there is no concrete footer 82, and the frame 12 is positioned only over a gravel base layer 80. It is appreciated that utilities 42 such as plumbing and electrical components can be placed in the gap 40 of the wall 10.

Referring to FIG. 1, a cable 90 can also extend through the gap 40 of the wood foundation wall 10 to provide further support to the foundation. It is appreciated that the cable 90 can extend through the entire building to provide support to the entire structure.

Figure 8:
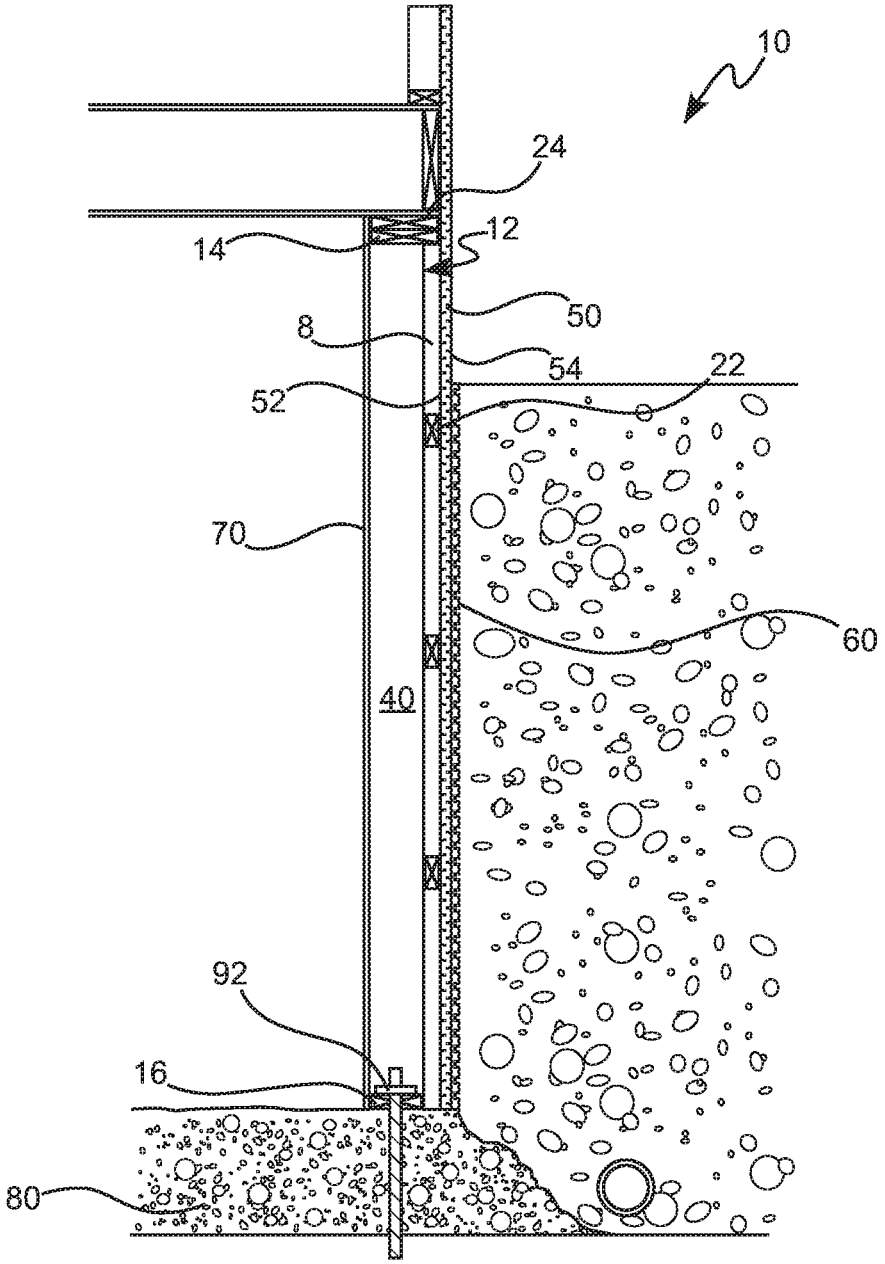
FIG. 8 illustrates a side cross-sectional view of a permanent wood foundation wall according to the present invention in which a rod is positioned through the second member and gravel layer.

As shown in FIG. 8, a rod 92 can be placed through at least a portion of the second member 16 (and optional end plate if used) and the gravel base 80 and into the soil prior to pouring concrete. For example, the rod 92 can extend through the soil at a length of at least 20 inches or at least 24 inches. The use of the rod 92 can help resist lateral loads from the back fill of gravel and soil against the wall 10 and prevent the wall 10 from sliding into the basement or crawlspace of the home prior to pouring a finished floor in the basement or crawlspace. The rod 92 will therefore help speed up the build cycle for the home and not be dependent on the timing of pouring the slab in the basement or crawlspace.

It was also found that the wood foundation wall 10 provides a fully integrated and insulated/waterproofed structure that is prepared offsite and which exhibits good energy efficiency properties, easy routing of utilities, and no condensation and moisture risks. In addition, the wood foundation wall 10 also provides significant cost savings because it can be prepared off-site with less materials and labor requirements.

Figure 9:
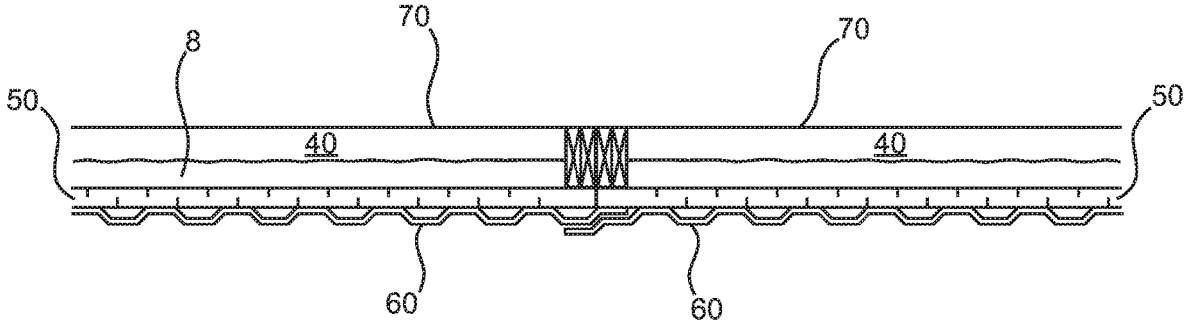
FIG. 9 illustrates two wood foundation wall according to the present invention in which a waterproofing membrane of a first wood foundation wall extends onto a waterproofing membrane of a second wood foundation wall.

It is appreciated that the wood foundation wall 10 can be used with other wall structures. For example, multiple wood foundation walls 10 can be used together in a basement and/or crawlspace. In such embodiments, the first member 12 of the wood foundation wall 10 can be placed below a second member 16 of a second wood foundation wall 10, directly or indirectly. As shown in FIG. 9, when two wood foundation walls 10 are used, the waterproofing membrane 60 of one of the wood foundation walls 10 can be extended over the waterproofing membrane 60 of the second wood foundation wall 10 in order to provide a continuous waterproofing barrier.

The wood foundation wall 10 can also be used with different wall structures such as wall structures used on different floors in which the wall foundation wall(s) 10 and the other wall structures extend together through the entire house or building.

While several embodiments of the invention were described in the foregoing detailed description, those skilled in the art may make modifications and alterations to these embodiments without departing from the scope and spirit of the invention. Accordingly, the foregoing description is intended to be illustrative rather than restrictive.

The invention claimed is:

1. A permanent wood foundation wall comprising:

a) a frame comprising:

a first member;

a second member spaced apart from the first member;

two side members extending between the first and second members, wherein the first member, second member, and two side members each have a front surface and a rear surface that form a front frame surface and a rear frame surface of the frame, and wherein a cavity is formed between the front frame surface and the rear frame surface of the frame, and secondary support members positioned within the foam layer and that extend horizontally through the foam layer between the side members, and blocking members placed between the secondary support members, wherein the first member, second member, and two side members are formed from a wood material comprising a preservative;

b) a sheathing board comprising (i) a first side attached to the rear frame surface of the frame such that the sheathing board is attached to the rear surface of the first member, second member, and two side members and (ii) a second side opposite the first side;

c) a waterproofing membrane applied to the second side of the sheathing board; and d) a foam layer formed within the cavity of the frame and which is bounded by the first member, the second member, two side members, and the sheathing board such that the foam layer is contained between (i) the rear surface of the first member, second member, and two side members, and (ii) the front surface of the first member, second member, and two side members.

2. The permanent wood foundation wall according to claim 1, further comprising an additional board attached to the front frame surface of the frame.

3. The permanent wood foundation wall according to claim 2, wherein the additional board is drywall.

4. The permanent wood foundation wall according to claim 1, wherein a gap is formed within the frame between the foam layer and the front frame surface.

5. The permanent wood foundation wall according to claim 1, wherein the foam layer is formed in situ during the manufacturing process.

6. The permanent wood foundation wall according to claim 1, wherein the preservative is a copper based preservative.

7. The permanent wood foundation wall according to claim 6, wherein the copper based preservative has a minimum retention level of 0.30 lbs per cubic foot of wood.

8. The permanent wood foundation wall according to claim 1, wherein the frame further comprises at least one primary support member positioned between the two side members and extending between the first and second members, wherein the primary support member defines a front primary support surface and an opposite rear primary support surface corresponding to the front frame surface and rear frame surface.

9. The permanent wood foundation wall according to claim 1, wherein the sheathing board comprises polyisocyanurate, wood, high density insulation, composites of plastic materials, metal, or any combination thereof.

10. The permanent wood foundation wall according to claim 1, wherein the sheathing board comprises polyisocyanurate.

11. The permanent wood foundation wall according to claim 1, wherein the waterproofing membrane comprises a rubberized membrane, a UV resistant polyethylene sheet with all seams and overlaps embedded into a sealant material, or a combination thereof.

12. The permanent wood foundation wall according to claim 1, wherein at least a portion of the second side of the sheathing board comprises a cementitious parge coating.

13. A foundation or crawlspace of a building comprising:

(i) a gravel base layer; and (ii) a permanent wood foundation wall positioned over the gravel base layer, the permanent wood foundation wall comprising:

a) a frame comprising:

a first member;

a second member spaced apart from the first member; and two side members extending between the first and second members, wherein the first member, second member, and two side members each have a front surface and a rear surface that form a front frame surface and a rear frame surface of the frame, and wherein a cavity is formed between the front frame surface and the rear frame surface of the frame, and secondary support members positioned within the foam layer and that extend horizontally through the foam layer between the side members, and blocking members placed between the secondary support members, wherein the first member, second member, and two side members are formed from a wood material comprising a preservative;

b) a sheathing board comprising a first side attached to the rear frame surface of the frame and a second side opposite the first side;

c) a waterproofing membrane applied to the second side of the sheathing board; and d) a foam layer formed within the cavity of the frame and which is bounded by the first member, the second member, two side members, and the sheathing board such that the foam layer is contained between (i) the rear surface of the first member, second member, and two side members, and (ii) the front surface of the first member, second member, and two side members.

14. The foundation or crawlspace according to claim 13, wherein a concrete footer is positioned between at least a portion of the second member of the frame and the gravel base.

15. The foundation or crawlspace according to claim 13, further comprising an additional board attached to the front frame surface of the frame.

16. The foundation or crawlspace according to claim 15, wherein the additional board is drywall.

17. The foundation or crawlspace according to claim 13, wherein a gap is formed within the frame between the foam layer and the front frame surface.

18. The foundation or crawlspace according to claim 13, wherein the foam layer is formed in situ during the manufacturing process.

19. The foundation or crawlspace according to claim 13, wherein the preservative is a copper based preservative.

20. The foundation or crawlspace according to claim 13, wherein the waterproofing membrane comprises a rubberized membrane, a UV resistant polyethylene sheet with all seams and overlaps embedded into a sealant material, or a combination thereof.

21. The foundation or crawlspace according to claim 13, wherein the sheathing board comprises polyisocyanurate, wood, high density insulation, composites of plastic materials, metal, or any combination thereof.

22. The foundation or crawlspace according to claim 13, wherein at least a portion of the second side of the sheathing board comprises a cementitious parge coating.

23. The foundation or crawlspace according to claim 13, further comprising a rod that extends through the second member of the permanent wood foundation wall and the gravel base layer.

* * * * *